US012078360B2

(12) United States Patent
Yamazoe et al.

(10) Patent No.: US 12,078,360 B2
(45) Date of Patent: Sep. 3, 2024

(54) RANGE HOOD

(71) Applicant: FUJIFILM Corporation, Tokyo (JP)

(72) Inventors: Shogo Yamazoe, Ashigara-kami-gun (JP); Yoshihiro Sugawara, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 1123 days.

(21) Appl. No.: 16/895,544

(22) Filed: Jun. 8, 2020

(65) Prior Publication Data

US 2020/0300478 A1 Sep. 24, 2020

Related U.S. Application Data

(63) Continuation of application No. PCT/JP2018/045499, filed on Dec. 11, 2018.

(30) Foreign Application Priority Data

Dec. 11, 2017 (JP) ..... 2017-237129

(51) Int. Cl.
*F24C 15/20* (2006.01)
*F24F 13/24* (2006.01)

(52) U.S. Cl.
CPC ..... *F24C 15/20* (2013.01); *F24F 13/24* (2013.01); *F24F 2013/242* (2013.01)

(58) Field of Classification Search
CPC ..... F24C 15/20; F24F 13/24; F24F 2013/242
(Continued)

(56) References Cited

U.S. PATENT DOCUMENTS 2,880,471 A * 4/1959 Heyno ..... E06B 3/825 52/404.1
5,720,274 A * 2/1998 Brunner ..... F24C 15/20 126/299 R (Continued)

FOREIGN PATENT DOCUMENTS

CN 106051867 A 10/2016
JP 10-103728 A 4/1998

(Continued)

OTHER PUBLICATIONS

Machine translation Japanese reference, 2014.*

(Continued)

*Primary Examiner* — Avinash A Savani
(74) *Attorney, Agent, or Firm* — Birch, Stewart, Kolasch & Birch, LLP

(57) ABSTRACT

Provided is a range hood that is small, that can reliably provide the flow path for waste smoke, that has high soundproof performance, and that allows oil stains and the like to be easily removed. The range hood includes: a suction portion that has a suction opening and that sucks air from below in a vertical direction; a connection opening connected to the suction portion; a duct portion that conveys air sucked from the connection opening and discharges the air from a discharge opening to an outside; an air blowing mechanism that is disposed in the duct portion and that moves air in the duct portion to the discharge opening; and a flow regulation plate that is disposed in the suction opening of the suction portion or is disposed so as to cover a part of the suction opening. A distance between the suction portion and the flow regulation plate is 110 mm or smaller. The range hood has at least one soundproof structure on a surface of the flow regulation plate on the suction portion side between the flow regulation plate and the suction portion.

14 Claims, 8 Drawing Sheets

(58) Field of Classification Search
USPC ..... 126/299 R
See application file for complete search history.

(56) References Cited

U.S. PATENT DOCUMENTS

| | | | | |
|---|---|---|---|---|
| 6,217,281 | B1 * | 4/2001 | Jeng | F04D 29/703 415/119 |
| 2004/0173099 | A1 * | 9/2004 | Ruckert | B01D 45/06 96/108 |
| 2006/0237262 | A1 * | 10/2006 | Parlade De Elia | F24C 15/20 181/290 |
| 2007/0209867 | A1 * | 9/2007 | Kim | E04F 15/20 181/292 |
| 2007/0272483 | A1 | 11/2007 | Morin et al. | |

FOREIGN PATENT DOCUMENTS

| | | | | |
|---|---|---|---|---|
| JP | 2007-17118 | A | 1/2007 | |
| JP | 2007-315386 | A | 12/2007 | |
| JP | 2009-127890 | A | 6/2009 | |
| JP | 2009-127931 | A | 6/2009 | |
| JP | 2013-2685 | A | 1/2013 | |
| JP | 2013-170807 | A | 9/2013 | |
| JP | 2015-94483 | A | 5/2015 | |
| WO | WO-2015029403 | A1 * | 3/2015 | F24C 15/20 |

OTHER PUBLICATIONS

International Preliminary Report on Patentability (Form PCT/IPEA/409) for International Application No. PCT/JP2018/045499, dated Nov. 25, 2019, with English translation.

International Search Report (Form PCT/ISA/210) for International Application No. PCT/JP2018/045499, dated Feb. 12, 2019, with English translation.

Written Opinion of the International Searching Authority (Form PCT/ISA/237) for International Application No. PCT/JP2018/045499, dated Feb. 12, 2019.

Japanese Notice of Reasons for Refusal for corresponding Japanese Application No. 2019-559659, dated Jul. 6, 2021, with an English translation.

* cited by examiner

RANGE HOOD

CROSS-REFERENCE TO RELATED APPLICATIONS

This application is a Continuation of PCT International Application No. PCT/JP2018/045499 filed on Dec. 11, 2018, which claims priority under 35 U.S.C. § 119(a) to Japanese Patent Application No. 2017-237129 filed on Dec. 11, 2017. The above application is hereby expressly incorporated by reference, in its entirety, into the present application.

BACKGROUND OF THE INVENTION

1. Field of the Invention

The present invention relates to a range hood.

2. Description of the Related Art

A range hood for discharging smoke, gas, and the like (hereafter, referred to as "waste smoke"), which are generated during cooking, to the outside is installed above a thermal cooker, such as a gas stove or an electric stove.

An air blowing mechanism such as an exhaust fan is disposed in the range hood, and waste smoke is discharged to the outside by driving the air blowing mechanism.

Here, a noise generated due to operation of the air blowing mechanism and a noise generated when waste smoke passes through the inside of the range hood cause a problem. In order to reduce such noises, it has been proposed that a soundproof structure be disposed in the range hood.

For example, JP2009-127931A describes a range hood that includes: a hood portion that has a suction gap along an opening edge of a trapping space that opens downward; and a fan unit that is placed on the hood portion so as to communicate with the trapping space via a communication opening that opens in the hood portion. The range hood is configured to discharge waste gas, which is sucked and trapped into the trapping space from the suction gap, to the outside from the communication opening through an exhaust duct connected to the fan unit. The range hood includes an oil trapping member that comes into contact with waste gas, which flows in the trapping space from the suction gap toward the communication opening, to change the direction of the flow of the waste gas, that traps oil from the waste gas, and that extends in a direction orthogonal to the direction of the flow of the waste gas. JP2009-127931A describes that the oil trapping member also functions as a fibrous sound absorbing material (paragraph [0045] and others). A part of the oil trapping member (sound absorbing material) is disposed in an exhaust gas box ([FIG. 1] and others).

JP2013-170807A describes a range hood that has a suction opening, for sucking cooking waste smoke, above a cooking heat source in a kitchen. The range hood is configured in such a way that a smoke duct is formed from a plurality of duct surfaces, which surround the suction opening, so as to extend to an exhaust fan that is installed in an outer wall that separates the kitchen from the outside. In the range hood, a cellular sound absorber that is composed a honeycomb cell, which is a parallelly-arranged set of numerous cells each having a thin tubular shape, and a honeycomb bottom surface, which is not gas-permeable and which closes one surface of the honeycomb cell, is attached to the suction opening; the cell sound absorber has outside dimensions smaller than the outside dimensions of the suction opening; and the cell sound absorber is attached in such a way that the honeycomb bottom surface closes the suction opening and the honeycomb cell faces inward so that a predetermined suction passage is left between the duct surface and the honeycomb bottom surface.

SUMMARY OF THE INVENTION

In general, a range hood is large and placed near the head of a user. Therefore, the range hood may cause the user to feel that the kitchen space is small or may impair the appearance of the kitchen. Therefore, reduction in size of a range hood, in particular, reduction in size of a suction portion is required.

However, when the size of a suction portion of a range hood is reduced, the space for placing a soundproof structure may be reduced or it may become impossible to place a soundproof structure in the space. It is conceivable that a soundproof structure may be placed in a duct portion. In this case, however, a problem arises in that discharging of waste smoke may be impeded because the soundproof structure narrows the flow path. Moreover, a problem arises in that, when the soundproof structure is placed in the duct portion, it becomes difficult to remove oil stains and the like adhering to the soundproof structure.

An object of the present invention is to solve the problems of the related art described above and to provide a range hood that is small, that can reliably provide the flow path for waste smoke, that has high soundproof performance, and that allows oil stains and the like to be easily removed.

The inventors have performed intensive examinations to achieve the above object and completed the present invention by configuring a range hood as follows: the range hood includes: a suction portion that has a suction opening and that sucks air from below in a vertical direction; a connection opening connected to the suction portion; a duct portion that conveys air sucked from the connection opening and discharges the air from a discharge opening to an outside; an air blowing mechanism that is disposed in the duct portion and that moves air in the duct portion to the discharge opening; and a flow regulation plate that is disposed in the suction opening of the suction portion or is disposed so as to cover a part of the suction opening. A distance between the suction portion and the flow regulation plate is 110 mm or smaller, and the range hood has at least one soundproof structure on a surface of the flow regulation plate on the suction portion side between the flow regulation plate and the suction portion.

That is, the inventors have found that the above object can be achieved by the following configurations.

[1] A range hood includes: a suction portion that has a suction opening and that sucks air from below in a vertical direction; a connection opening connected to the suction portion; a duct portion that conveys air sucked from the connection opening and discharges the air from a discharge opening to an outside; an air blowing mechanism that is disposed in the duct portion and that moves air in the duct portion to the discharge opening; and a flow regulation plate that is disposed in the suction opening of the suction portion or is disposed so as to cover a part of the suction opening. A distance between the suction portion and the flow regulation plate is 110 mm or smaller. The range hood has at least one soundproof structure on a surface of the flow regulation plate on the suction portion side between the flow regulation plate and the suction portion.

[2] The range hood described in [1], in which the distance between the suction portion and the flow regulation plate is 1 mm or larger and 110 mm or smaller.

[3] The range hood described in [1] or [2], in which a thickness of the soundproof structure is 100 mm or smaller.

[4] The range hood described in any one of [1] to [3], in which an opening area of the suction opening of the suction portion is larger than an opening area of the connection opening, and an area of the surface of the flow regulation plate on which the soundproof structure is disposed is smaller than the opening area of the suction opening and larger than the opening area of the connection opening.

[5] The range hood described in any one of [1] to [4], in which the air blowing mechanism is disposed on the connection opening side in the duct portion.

[6] The range hood described in any one of [1] to [5], having two or more soundproof structures having different frequency characteristics.

[7] The range hood described in [6], in which a sound reduction peak frequency of one of the soundproof structures disposed on a side closer to the connection opening is higher than a sound reduction peak frequency of another of the soundproof structures disposed on a side farther from the connection opening.

[8] The range hood described in [6] or [7], in which one of the soundproof structures disposed on a side closer to the connection opening has a peak of sound absorption coefficient at a frequency higher than a cut-off frequency in a flow path that is formed from the suction portion, the duct portion, the air blowing mechanism, and the flow regulation plate, and another of the soundproof structures disposed on a side farther from the connection opening has a peak of sound absorption coefficient at a frequency lower than or equal to the cut-off frequency.

[9] The range hood described in any one of [1] to [8], in which at least one of the soundproof structure has a frame having at least one open surface and a membrane member disposed at the open surface of the frame, and the membrane member is a membrane resonator that performs membrane vibration.

[10] The range hood described in any one of [1] to [9], in which the soundproof structure has at least one acoustic resistance sheet whose acoustic flow resistivity is 10 to 5000 $Pa \cdot s/m^2$.

[11] The range hood described in any one of [1] to [10], in which at least one of the soundproof structure is a micro-perforated sheet having a plurality of through-holes whose average opening diameter is 0.1 μm to 250 μm.

[12] The range hood described in any one of [1] to [11], in which at least one of the soundproof structure is a Helmholtz resonator.

[13] The range hood described in any one of [1] to [12], in which at least one of the soundproof structure is an air-column resonator.

[14] The range hood described in any one of [1] to [13], in which at least one of the soundproof structure is a porous sound absorber.

[15] The range hood described in any one of [1] to [14], in which the soundproof structure is made of a fire-retardant material or an incombustible material.

[16] The range hood described in any one of [1] to [15], in which the soundproof structure is attached to the flow regulation plate via a removable mechanism.

With the present invention, it is possible to provide a range hood that is small, that can reliably provide the flow path for waste smoke, that has high soundproof performance, and that allows oil stains and the like to be easily removed.

DESCRIPTION OF THE PREFERRED EMBODIMENTS

Hereafter, the present invention will be described in detail.

The following descriptions of constituent elements may be made based on representative embodiments of the present invention. However, the present invention is not limited to such embodiments.

In the present specification, a numerical range that is represented by using "to" means a range that includes a value before "to" as the lower limit value and a value after "to" as the upper limit value.

In the present specification, an angle such as "45°", "parallel", "perpendicular", or "orthogonal" means an angle such that the difference from the strict angle is smaller than 5 degrees, unless otherwise noted. The difference from the strict angle is preferably smaller than 4 degrees, and more preferably smaller than 3 degrees.

In the present specification, "the same" and "identical" includes an error range that is generally allowed in the technical field. In the present specification, "entirety", "any of", "fully", or the like includes, in addition to 100%, an error range that is generally allowed in the technical field, such 99% or more, 95% or more, or 90% or more.

[Range Hood]

A range hood according to the present invention includes: a suction portion that has a suction opening and that sucks air from below in a vertical direction; a connection opening connected to the suction portion; a duct portion that conveys air sucked from the connection opening and discharges the air from a discharge opening to an outside; an air blowing mechanism that is disposed in the duct portion and that moves air in the duct portion to the discharge opening; and a flow regulation plate that is disposed in the suction opening of the suction portion or is disposed so as to cover a part of the suction opening. A distance between the suction portion and the flow regulation plate is 110 mm or smaller. The range hood has at least one soundproof structure on a surface of the flow regulation plate on the suction portion side between the flow regulation plate and the suction portion.

An example of a range hood according to the present invention will be described with reference to the drawings.

Figure 1:
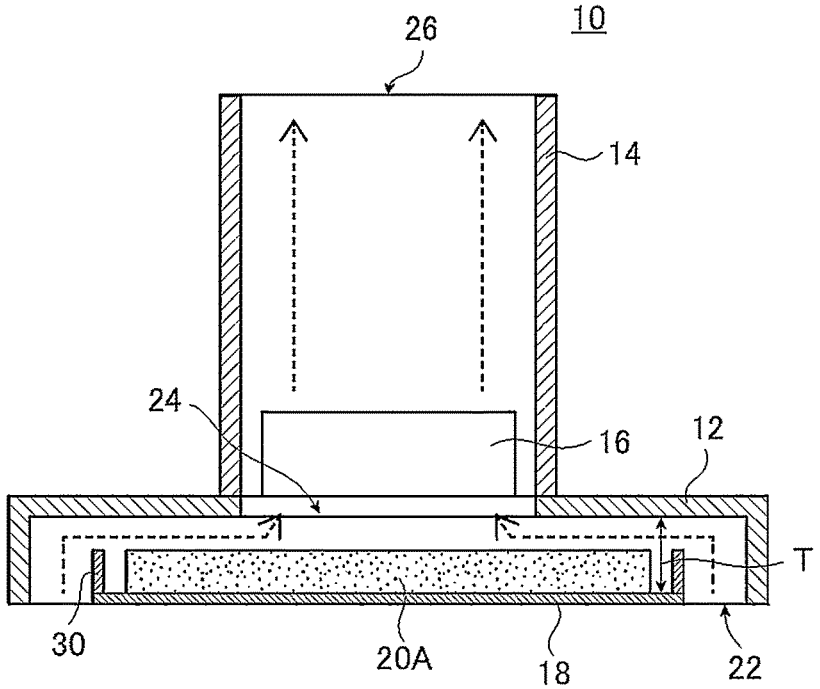
FIG. 1 is a schematic sectional view illustrating an example of a range hood according to the present invention.

FIG. 1 is a schematic sectional view illustrating an example of a range hood according to the present invention.

As illustrated in FIG. 1, a range hood 10 has a suction portion 12, a duct portion 14, an air blowing mechanism 16, a flow regulation plate 18, and a soundproof structure 20 (a porous sound absorber 20A).

The suction portion 12 has a rectangular-parallelepiped shape having a small thickness in the vertical direction. The suction portion 12 has a suction opening 22, which is fully open, in one of largest surfaces thereof that is a surface on the lower side in the vertical direction, and has a connection opening 24, which is smaller than the suction opening 22, in the other largest surface (a surface on the upper side in the vertical direction). That is, the opening area of the suction opening 22 is larger than the opening area of the connection opening 24.

At the connection opening 24, the duct portion 14 is connected to the suction portion 12.

Waste smoke that the suction portion 12 has sucked from the suction opening 22 flows from the connection opening 24 into the duct portion 14.

The shape of the suction portion 12 is not limited, and may be any of various shapes, such as a substantially rectangular-parallelepiped shape, a round columnar shape, a polygonal columnar shape, a quadrangular frustum shape, a conical frustum shape, a polygonal frustum shape, and the like.

The shapes of the suction opening 22 and the connection opening 24 are not particularly limited, and may be any of various shapes such as a quadrangular shape, a circular shape, a polygonal shape, and the like.

The inner side surface and the outer side surface of the suction portion 12 may have protrusions and recesses.

The duct portion 14 is a known duct portion that is used in existing range hoods. The duct portion 14 is a pipe-shaped member, has the connection opening 24, which is connected to the suction portion 12, in one of end surfaces thereof, and has a discharge opening 26, for discharging waste smoke, in the other end surface thereof.

The duct portion 14 discharges, from the discharge opening 26, waste smoke that the suction portion 12 has sucked and that has flowed thereinto from the connection opening 24.

The shape of the duct portion 14 is not limited, and may be any of various shapes such as a substantially rectangular-parallelepiped shape, a round columnar shape, a polygonal columnar shape, and the like.

The shape of the opening cross section of the duct portion 14 is not particularly limited, and may be any of various shapes such as a quadrangular shape, a circular shape, a polygonal shape, and the like.

The outer side surface and the inner side surface of the duct portion 14 may have protrusions and recesses.

The air blowing mechanism 16 is a known air blowing mechanism 16 used in existing range hoods, such as a fan.

The air blowing mechanism 16 moves waste smoke in the duct portion 14 from the connection opening 24 side to the discharge opening 26 side by rotational motion.

In the example illustrated in FIG. 1, the air blowing mechanism 16 is disposed on the connection opening 24 (the suction portion 12) side of the duct portion 14.

The flow regulation plate 18 is a plate-shaped member, and is disposed in the suction opening 22 of the suction portion 12 or is disposed so as to cover a part of the suction opening 22. The size (area) of the flow regulation plate 18 in the in-plane direction is smaller than the opening area of the suction opening 22 of the suction portion 12 and is larger than the opening area of the connection opening 24.

In the example illustrated in FIG. 1, the flow regulation plate 18 is disposed so as to be substantially flush with the suction opening 22. Because the flow regulation plate 18 is smaller than the suction opening 22, the suction opening 22, at which the flow regulation plate 18 is disposed, is not completely closed, and is partially open. As indicted by broken-line arrows in FIG. 1, the suction portion 12 sucks waste smoke from the opening. As indicted by broken-line arrows in FIG. 1, sucked waste smoke passes through a space between the suction portion 12 and the flow regulation plate 18 (the porous sound absorber 20A), and flows into the connection opening 24.

In view of rigidity, reduction in size, and the like, the thickness of the flow regulation plate 18 is preferably 2 mm or smaller, and more preferably 0.1 mm or larger and 1 mm or smaller.

Here, in the present invention, the distance T between the flow regulation plate 18 and the suction portion 12 in the vertical direction is 110 mm or smaller. By making the distance T between the flow regulation plate 18 and the suction portion 12 be 110 mm or smaller, the size of the range hood can be reduced. Airflow noise is easily generated when the distance T between the flow regulation plate 18 and the suction portion 12 is as short as 110 mm or smaller. However, in the present invention, because a soundproof structure is disposed on the flow regulation plate 18 and airflow noise can be reduced, the present invention can be suitably applied to a configuration in which the distance T between the flow regulation plate 18 and the suction portion 12 is 110 mm or smaller.

The distance T is the shortest distance between the flow regulation plate 18 and the suction portion 12 in the vertical direction. Accordingly, for example, when the flow regulation plate 18 and the upper surface of the suction portion 12 are not parallel, such as when the upper surface of the suction portion 12 is inclined, the distance T is defined as the shortest distance between the flow regulation plate 18 and the suction portion 12.

When the distance T between the flow regulation plate 18 and the suction portion 12 is smaller than 1 mm, the amount of sucked air (discharged air) considerably decreases, and the functionality of the range hood decreases. Therefore, preferably, the distance T between the flow regulation plate 18 and the suction portion 12 is 1 mm or larger.

In view of reduction in size, air discharge performance, soundproof performance, and the like, the distance T between the flow regulation plate 18 and the suction portion 12 is preferably 5 mm or larger and 90 mm or smaller, more preferably 10 mm or larger and 75 mm or smaller, and further preferably 20 mm or larger and 50 mm or smaller.

In the example illustrated in the figure, a bent portion 30 is formed on the upper side of the end portion of the flow regulation plate 18 in the in-plane direction. When the flow regulation plate 18 has the bent portion 30, the distance T is defined as the shortest distance between the largest surface of the flow regulation plate 18 on the upper side and the suction portion 12.

The soundproof structure 20 is a member for absorbing sound that passes through the inside of the range hood. In the example illustrated in FIG. 1, the porous sound absorber 20A is used as the soundproof structure 20.

As described below in detail, the soundproof structure 20 is not limited to the porous sound absorber 20A. As the soundproof structure 20, an air-column resonator 20B, a Helmholtz resonator 20C, a membrane resonator 20D, and a micro-perforated sheet 20E can be used. In the following description, when it is not necessary to discriminate between the porous sound absorber 20A, the air-column resonator 20B, the Helmholtz resonator 20C, the membrane resonator 20D, and the micro-perforated sheet 20E, these will be collectively referred to as the soundproof structure 20.

The soundproof structure 20 is disposed on a surface of the flow regulation plate 18 on the suction portion 12 side (vertically upper side). The soundproof structure 20 is disposed in a space between the flow regulation plate 18 and the suction portion 12, that is, below the connection opening 24.

In order to reliably provide the flow path for waste smoke, the suction portion 12 and the soundproof structure 20 are separated from each other by a predetermined distance.

In view of reduction in size, air discharge performance, soundproof performance, and the like, the thickness of the soundproof structure 20 is preferably 1 mm or larger and 100 mm or smaller, more preferably 5 mm or larger and 50 mm or smaller, and further preferably 10 mm or larger and 20 mm or smaller.

The thickness of the soundproof structure 20 is measured with resolving power of 1 mm. That is, when the soundproof structure 20 has protrusions and recesses or the like smaller than 1 mm, the thickness may be obtained by averaging these.

As described above, in general, a range hood is large and placed near the head of a user. Therefore, the range hood may cause the user to feel that the kitchen space is small or may impair the appearance of the kitchen. Therefore, reduction in size of a range hood, in particular, reduction in size of a suction portion is required.

However, when the size of a suction portion of a range hood is reduced, the space for placing a soundproof structure may be reduced or it may become impossible to place a soundproof structure in the space. It is conceivable that a soundproof structure may be placed in a duct portion. In this case, however, a problem arises in that discharging of waste smoke may be impeded because the soundproof structure narrows the flow path. Moreover, a problem arises in that, when the soundproof structure is placed in the duct portion, it becomes difficult to remove oil stains and the like adhering to the soundproof structure.

In contrast, in the range hood according to the present invention, the distance between the suction portion and the flow regulation plate is 110 mm or smaller, and the range hood has at least one soundproof structure on a surface of a flow regulation plate on the suction portion side between the flow regulation plate and the suction portion. The size of the range hood according to the present invention can be reduced, because the distance between the suction portion and the flow regulation plate is as short as 110 mm or smaller. Because the soundproof structure is disposed between the flow regulation plate and the suction portion, the range hood can prevent decrease of air discharge performance due to narrowing of the flow path in the duct portion. Because the soundproof structure is disposed in the small space between the flow regulation plate and the suction portion, the soundproof structure can efficiently absorb sound that passes through the small space. Because the soundproof structure is disposed on the flow regulation plate, noise perpendicularly enters the soundproof structure, and therefore high sound absorbing effect can be obtained. Because the soundproof structure is disposed on the flow regulation plate, oil stains and the like adhering to the soundproof structure can be easily removed.

Here, as described above, as the soundproof structure 20, any of the porous sound absorber 20A, the air-column resonator 20B, the Helmholtz resonator 20C, the membrane resonator 20D, and the micro-perforated sheet 20E may be used.

FIG. 1 illustrates an example in which the porous sound absorber 20A is used as the soundproof structure 20.

As is well known, a porous sound absorber is a member that absorbs sound by using the viscous drag of air and the like when an acoustic wave passes through hollow spaces in the material.

The porous sound absorber 20A is not particularly limited, and a known porous sound absorber may be used as appropriate. Examples of a known porous sound absorber that can be used include: foam materials and materials including micro air spaces, such as polyurethane foam, flexible urethane foam, wood, ceramics particle sintered material, and phenol foam; fibers and non-woven fabric materials, such as glass wool, rock wool, micro fiber (Thinsulate made by 3M Corporation), floor mat, carpet, melt-blown non-woven fabric, metal non-woven fabric, polyester non-woven fabric, metal wool, felt, insulation board, glass non-woven fabric; wood-wool cement board; nanofiber materials such as silica nanofiber; and plasterboard.

The flow resistivity $\sigma_1$ of the porous sound absorber, which is not particularly limited, is preferably 1000 to 100000 (Pa·s/m$^2$), more preferably 5000 to 80000 (Pa·s/m$^2$), and further preferably 10000 to 50000 (Pa·s/m$^2$).

It is possible to evaluate the flow resistivity of a porous sound absorber by measuring the normal-incidence sound absorption coefficient of the porous sound absorber having a thickness of 1 cm and by performing fitting by using the Miki model (J. Acoust. Soc. Jpn., 11 (1) pp. 19-24 (1990)). Alternatively, evaluation may be performed in accordance with "ISO 9053".

Figure 2:
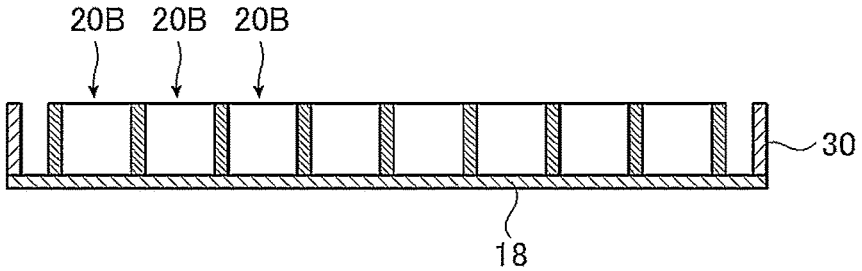
FIG. 2 is a schematic sectional view illustrating an example of a soundproof structure.

FIG. 2 illustrates an example in which the air-column resonator 20B is used as the soundproof structure 20.

As is well known, air-column resonance is a phenomenon that occurs in a standing wave generated in a resonance tube. The air-column resonator 20B absorbs sound by using the viscous drag of air at a tube end at the frequency of the air-column resonance.

The length of the air-column resonator 20B, the area of the opening, and the like may be appropriately set in accordance with the frequency of sound to be absorbed.

Figure 3:
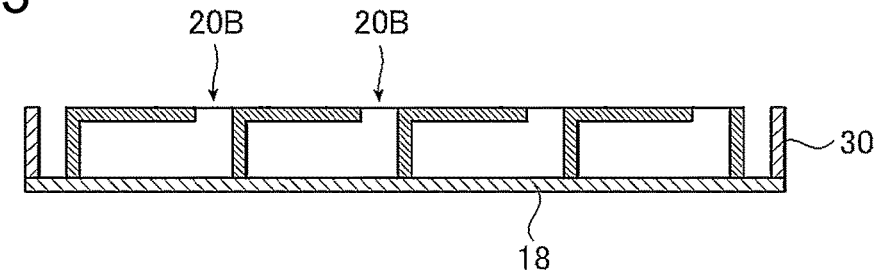
FIG. 3 is a schematic sectional view illustrating another example of a soundproof structure.

In the example illustrated in FIG. 2, the resonance tube, which functions as the air-column resonator 20B, has a depth in a direction perpendicular to the flow regulation plate 18. However, the configuration of the resonance tube is not limited to this. As in the example illustrated in FIG. 3, the resonance tube, which functions as the air-column resonator 20B, may have a depth in a direction parallel to the flow regulation plate 18. In this case, as illustrated in FIG. 3, an opening may be formed in a side surface of the resonance tube in the depth direction (in FIG. 3, a surface on the side closer to the connection opening 24). By forming the resonance tube, which functions as the air-column resonator 20B, so as to have a depth in a direction parallel to the flow regulation plate 18, even when the distance between the suction portion and the flow regulation plate is small, the depth of the resonance tube can be increased, and therefore the resonant frequency can be reduced.

Figure 4:
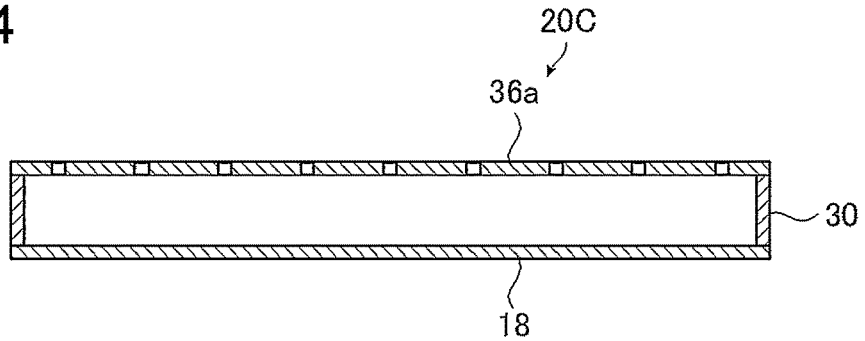
FIG. 4 is a schematic sectional view illustrating another example of a soundproof structure.

FIG. 4 illustrates an example in which the Helmholtz resonator 20C is used as the soundproof structure 20.

As is well known, Helmholtz resonance is a phenomenon in which air that is inside (a hollow portion) of a container having an opening serves as a spring and resonates. The Helmholtz resonator 20C has a structure such that air in the opening serves as a mass and air in the hollow portion serves as a spring to cause mass-spring resonance, and absorbs sound by using thermal viscous friction in the vicinity of the wall of the opening.

In the example illustrated in FIG. 4, the Helmholtz resonator 20C has a configuration such that a plate-shaped perforated plate 36*a*, which has a plurality of through-holes, is placed on the bent portion 30 disposed at the edge of the flow regulation plate 18. With such a configuration, the space surrounded by the flow regulation plate 18, the bent portion 30, and the perforated plate 36*a* functions as the hollow portion, and the through-holes of the perforated plate 36*a* function as the opening, thereby forming a resonator that causes Helmholtz resonance.

The volume of the hollow portion of the Helmholtz resonator 20C, the area of the opening, and the like may be appropriately set so that the resonant frequency of Helmholtz resonance matches the frequency of sound to be absorbed.

Figure 5:
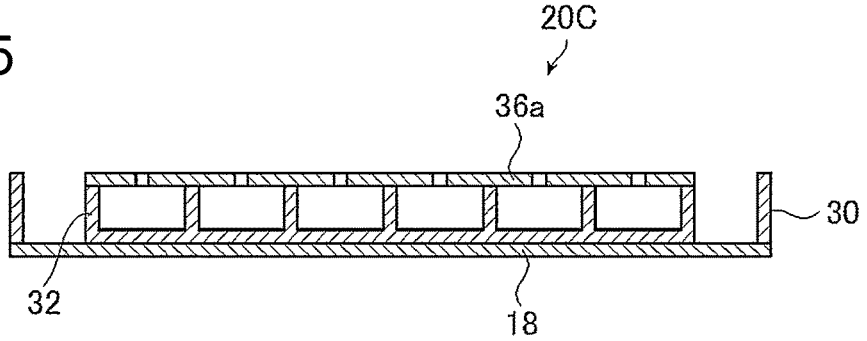
FIG. 5 is a schematic sectional view illustrating another example of a soundproof structure.

In the example illustrated in FIG. 4, the Helmholtz resonator has one hollow portion and a large number of through-holes. However, the configuration of the Helmholtz resonator is not limited to this. As in the example illustrated in FIG. 5, on a frame 32 having a plurality of hollow portions, a perforated plate 36*a*, in which through-holes are formed in accordance with the positions of the hollow portions, may be disposed, so that the combinations of the hollow portions and the through-holes each function as a Helmholtz resonator.

Figure 6:
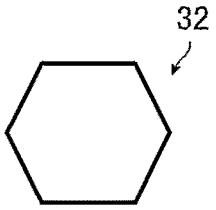
FIG. 6 is a top view of an example of a frame.

The shape of the hollow portion formed in the frame 32 is not particularly limited. The shape of the hollow portion in plan view (when seen from an upper side in FIG. 5) may be any of various shapes such as polygonal shapes including a quadrangular shape, a triangular shape, and a pentagonal shape; a circular shape; an elliptical shape; a hexagonal shape as illustrated in FIG. 6; and an irregular shape.

Figure 7:
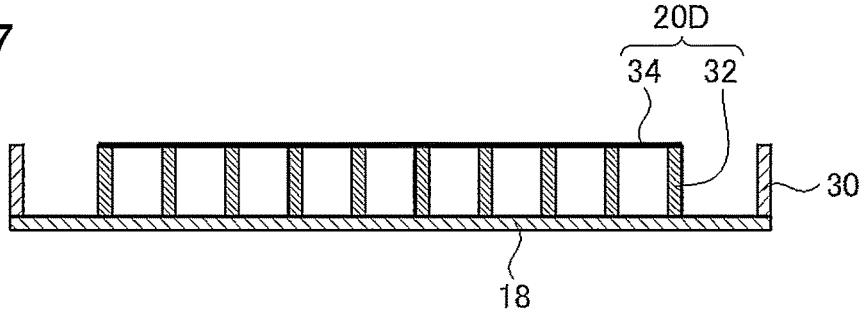
FIG. 7 is a schematic sectional view illustrating another example of a soundproof structure.

FIG. 7 illustrates an example in which the membrane resonator 20D is used as the soundproof structure 20.

As illustrated in FIG. 7, the membrane resonator 20D has a frame 32 having at least one open surface, and a membrane member 34 disposed at the open surface of the frame 32. The membrane member 34 covers the open surface of the frame 32, and is supported so that the membrane member 34 can vibrate with a peripheral edge portion thereof being fixed to the frame 32. The membrane resonator 20D is structured to absorb sound by using membrane vibration of the membrane member 34.

In the membrane resonator 20D, which uses membrane vibration, the resonant frequency of membrane vibration may be appropriately set so as to match the frequency of sound to be absorbed.

The resonant frequency of the membrane vibration is determined by the size, thickness, hardness (material), and the like of the membrane member 34. Accordingly, by adjusting the size, thickness, hardness, and the like of the membrane member 34, it is possible to appropriately set the frequency of sound with which the membrane resonator 20D resonates. For example, the resonant frequency can be reduced by using a denser or softer material as the material of the membrane member.

Figure 8:
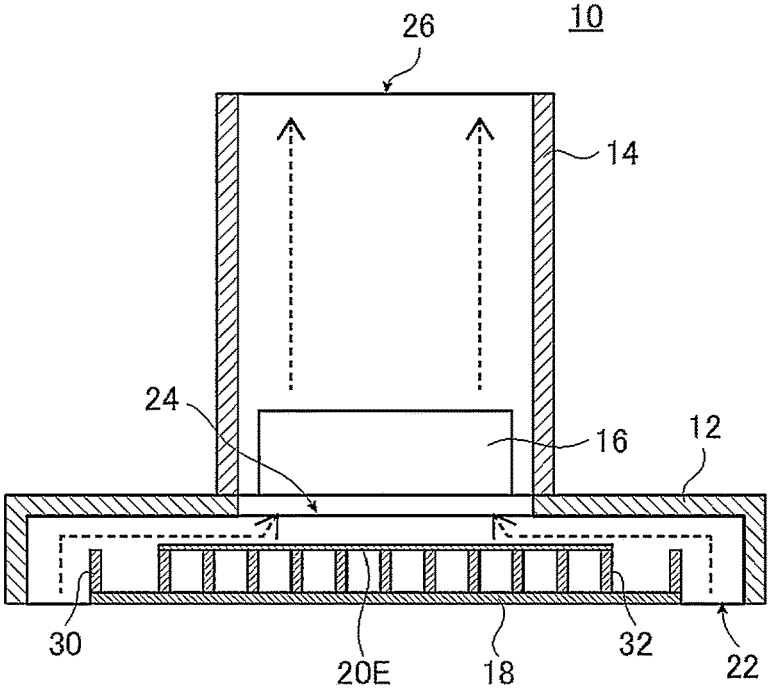
FIG. 8 is a schematic sectional view illustrating another example of a range hood according to the present invention.

FIG. 8 illustrates an example in which the micro-perforated sheet 20E is used as the soundproof structure 20.

Figure 9:
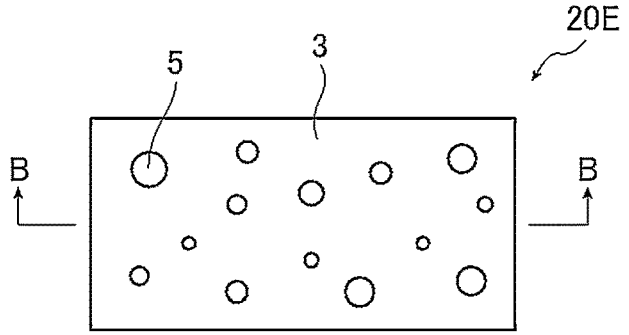
FIG. 9 is a schematic front view illustrating an example of a micro-perforated sheet.
Figure 10:
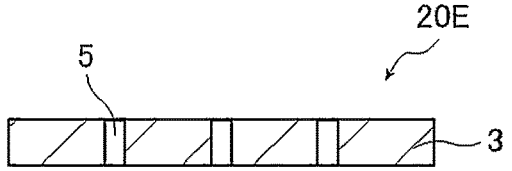
FIG. 10 is a sectional view taken along line B-B in FIG. 9.

FIG. 9 is a plan view illustrating an example of the micro-perforated sheet 20E. FIG. 10 is a sectional view taken along line B-B in FIG. 9.

As illustrated in FIGS. 9 and 10, the micro-perforated sheet 20E is member in which a large number of micro through-holes 5, whose average opening diameter is 0.1 μm to 250 μm, are formed in a sheet member 3. Examples of the material of the sheet member 3 include metal materials, such as aluminum, and various resin materials.

The principle behind sound absorption by a micro-perforated sheet is that the micro-perforated sheet absorbs sound by using friction between air and the inner walls of the micro through-holes, whose average opening diameter is 0.1 μm to 250 μm, when an acoustic wave (air) passes through the through-holes. This mechanism, which is based on the microscopic size of the through-holes, differs from the mechanism of resonance. The impedance of a path through which sound in air directly passes through the through-holes is considerably lower than that of a path along which sound is once converted into membrane vibration and then emitted again as sound. Accordingly, sound can more easily pass through the path formed by the micro through-holes than membrane vibration. When sound passes through the through-hole portions, the sound passes while being concentrated from a large area on the entirety of a sheet member to a smaller area in the through-holes. As sound concentrates in the through-holes, the local speed of the sound considerably increases. Because friction is correlated with the speed, friction increases in the micro through-holes and is converted into heat.

It is considered that, when the average opening diameter of the through-holes is small, the ratio of the edge length of the through-holes to the opening area is high, and therefore it is possible to increase friction that is generated at the edge portions and the inner wall surfaces of the through-holes. By increasing friction that is generated when sound passes through the through-holes, it is possible to absorb sound by converting acoustic energy into thermal energy.

The inventors have examined and found that there exists an optimum average opening ratio of the through-holes and, in particular, when the average opening diameter is comparatively as large as about 50 μm or larger, the absorption coefficient increases as the average opening ratio decreases. When the average opening ratio is high, sound passes through each of a large number of through-holes. In contrast, when the average opening ratio is low, because the number of through-holes decreases, the amount of sound that passes through each of the through-holes increases, and therefore, it is considered that the local speed of air when passing through the through-hole increases and friction that is generated at the edge portion and the inner wall surface of the through-hole can be increased.

In view of sound-absorbing performance, the average opening diameter of the through-holes 5 is preferably 1 μm or larger and smaller than 100 μm, and more preferably 5 or larger and 50 μm or smaller. In view of sound-absorbing performance, the average opening ratio of the through-holes 5 is preferably 0.1% or higher and 20% or lower.

Instead of a micro-perforated sheet having micro through-holes of 0.1 μm to 250 μm, an acoustic resistance sheet having acoustic resistance that can produce a sound absorbing effect based on the mechanism described above may be used. For example, the acoustic resistance sheet may be a fibrous sheet made from non-woven fabric, woven fabric, or knit fabric; or a foam such as urethane foam.

Preferably, these are incombustible. Preferably, these are replaceable when stained with oil or the like. These may be used alone or may be used in combination with another soundproof structure such as a porous sound absorber, a membrane resonator, a Helmholtz resonator, or an air-column resonator. In this case, by disposing the acoustic resistance sheet on the other soundproof structure, it is possible to prevent the other soundproof structure from stained.

The acoustic flow resistivity of the acoustic resistance sheet is preferably 10 to 5000 Rayls ($Pa \cdot s/m^2$). The acoustic flow resistivity is more preferably 100 to 2500 Rayls, and further preferably 300 to 1500 Rayls.

Here, it is sufficient for a range hood according to the present invention to have at least one soundproof structure 20. That is, the range hood may have one soundproof structure 20 or may have two or more soundproof structures 20.

When the range hood has two or more soundproof structures 20, the range hood may have soundproof structures 20 of the same type or may have soundproof structures 20 of different types.

For example, as in the example illustrated in FIGS. 2 and 3, the range hood may have a plurality of air-column resonators 20B as the soundproof structures 20.

Figure 11:
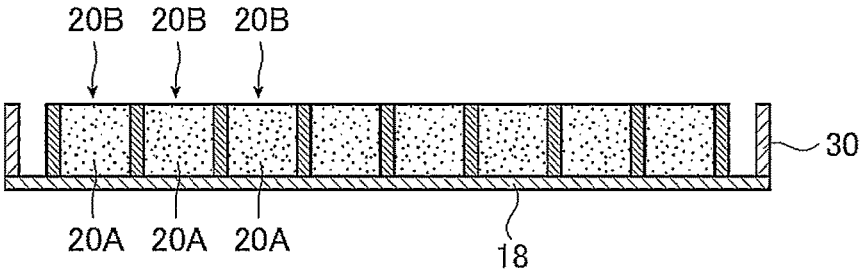
FIG. 11 is a schematic sectional view illustrating another example of a soundproof structure.

Alternatively, as in the example illustrated in FIG. 11, the range hood may have the air-column resonator 20B and the porous sound absorber 20A as the soundproof structures 20. In the example illustrated in FIG. 11, the porous sound absorber 20A is disposed in the air-column resonator 20B.

Figure 12:
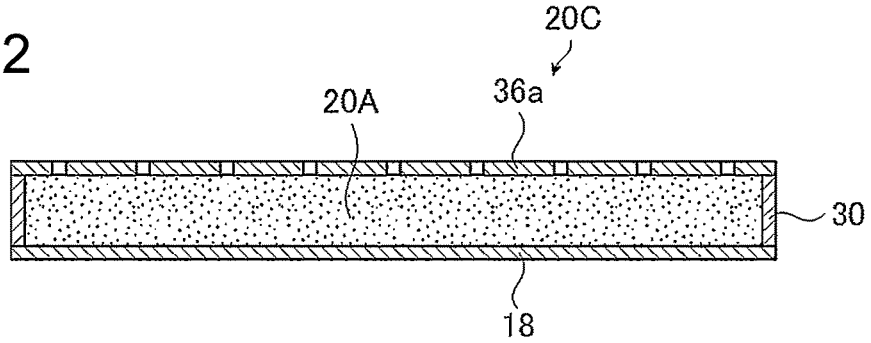
FIG. 12 is a schematic sectional view illustrating another example of a soundproof structure.

As in the example illustrated in FIG. 12, the range hood may have the Helmholtz resonator 20C and the porous sound absorber 20A as the soundproof structures 20. In the example illustrated in FIG. 12, the porous sound absorber 20A is disposed in the Helmholtz resonator 20C.

Figure 13:
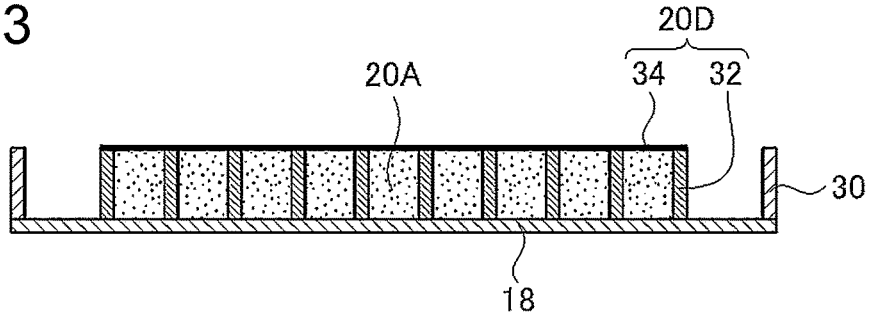
FIG. 13 is a schematic sectional view illustrating another example of a soundproof structure.

As in the example illustrated in FIG. 13, the range hood may have the membrane resonator 20D and the porous sound absorber 20A as the soundproof structures 20. In the example illustrated in FIG. 13, the porous sound absorber 20A is disposed in the frame 32 of the membrane resonator 20D.

Figure 14:
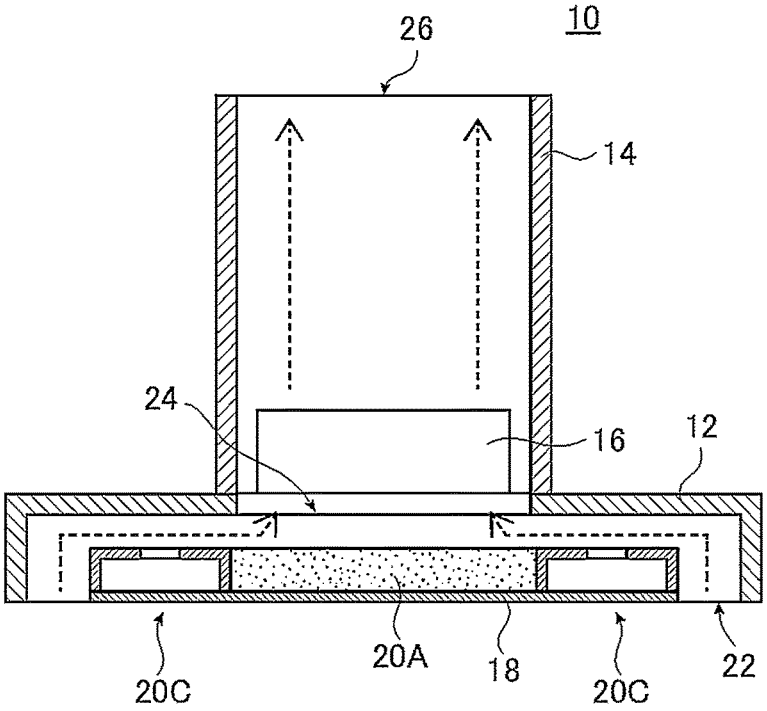
FIG. 14 is a schematic sectional view illustrating another example of a range hood according to the present invention.

As in the example illustrated in FIG. 14, the range hood may have the Helmholtz resonator 20C and the porous sound absorber 20A as the soundproof structures 20. In the example illustrated in FIG. 14, the Helmholtz resonator 20C and the porous sound absorber 20A are arranged in the in-plane direction of the flow regulation plate 18.

As in these examples, when the range hood has soundproof structures 20 of different types, the combination of the types of the soundproof structures 20 is not particularly limited. Instead of two types of soundproof structures 20, the range hood may have three or more types of soundproof structures 20.

In FIGS. 11 to 13, the porous sound absorber 20A is disposed in the soundproof structure 20, and, in FIG. 14, two types of soundproof structures 20 are arranged in the in-plane direction of the flow regulation plate 18. However, this is not a limitation.

Figure 15:
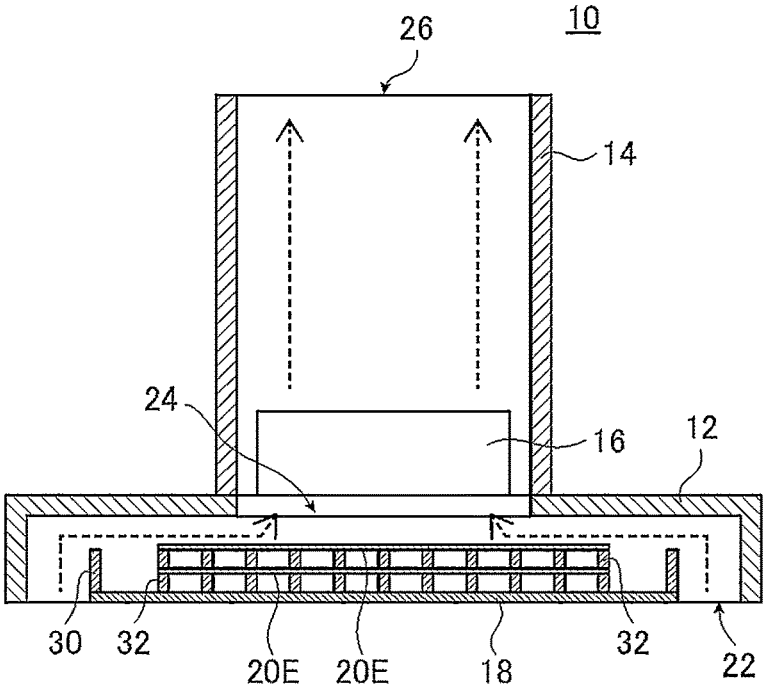
FIG. 15 is a schematic sectional view illustrating another example of a range hood according to the present invention.

As in the example illustrated in FIG. 15, two micro-perforated sheets 20E may be arranged in a direction perpendicular to the flow regulation plate 18. In FIG. 15, a first frame 32 is disposed on the flow regulation plate 18, a first micro-perforated sheet 20E is disposed on the first frame 32, a second frame 32 is disposed on the first micro-perforated sheet 20E, and a second micro-perforated sheet 20E is disposed on the second frame.

When the range hood has two or more soundproof structures, preferably, the range hood has two or more soundproof structures having different frequency characteristics. By having two or more soundproof structures having different frequency characteristics, it is possible to block sound in a wider frequency range.

The soundproof structures 20 having different frequency characteristics may be soundproof structures 20 of the same type having different specifications or may be soundproof structures 20 of different types.

Figure 16:
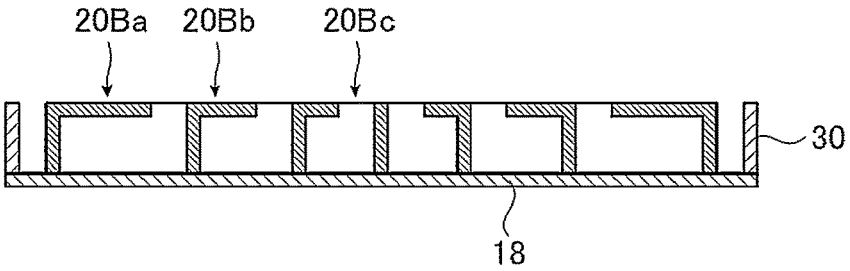
FIG. 16 is a schematic sectional view illustrating another example of a soundproof structure.

For example, as in the example illustrated in FIG. 16, the range hood may have air-column resonators 20Ba, 20Bb, and 20Bc, which are the same air-column resonators 20B as a type of the soundproof structure 20 and which have different specifications such as dimensions and thus have different frequency characteristics. The air-column resonators 20Ba, 20Bb, and 20Bc have resonance tubes having different lengths (lengths in the left-right direction in FIG. 16) and thus have different resonant frequencies.

Figure 17:
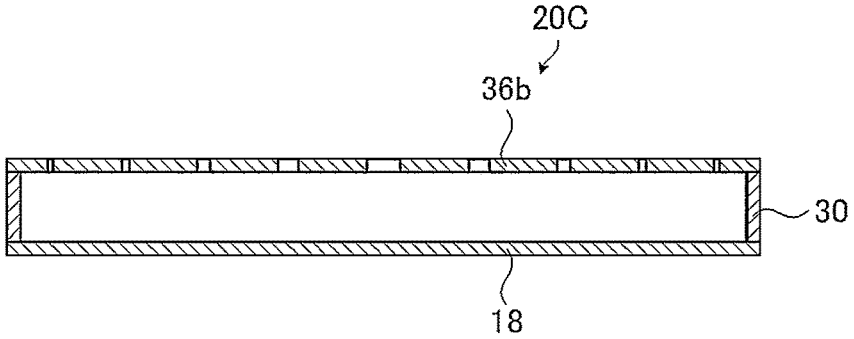
FIG. 17 is a schematic sectional view illustrating another example of a soundproof structure.

In the example illustrated in FIG. 17, the range hood has the Helmholtz resonator 20C, which is the same Helmholtz resonator 20C as a type of the soundproof structure 20 and which has different specifications such as the opening diameter (diameter) of the opening and thus have different frequency characteristics. The example illustrated in FIG. 17 has a configuration such that a plate-shaped perforated plate 36*b*, which has a plurality of through-holes, is placed on the bent portion 30 disposed at the edge of the flow regulation plate 18. The perforated plate 36*b* has a plurality of through-holes having different diameters, and Helmholtz resonance occurs as each of the through-holes functions as an opening. The space surrounded by the flow regulation plate 18, the bent portion 30, and the perforated plate 36*b* functions as a hollow portion common to the through-holes. The Helmholtz resonator 20C causes resonance at different frequencies, because the perforated plate 36*b* has through-holes having different diameters.

Alternatively, as in the example illustrated in FIG. 11, the range hood may have the air-column resonator 20B and the porous sound absorber 20A as the soundproof structures 20, the air-column resonator 20B and the porous sound absorber 20A having different frequency characteristics, so that the range hood may have soundproof structures 20 of different types and having different frequency characteristics.

When the range hood has two or more soundproof structures having different frequency characteristics, preferably, one of the soundproof structures 20 disposed on a side closer to the connection opening 24 has frequency characteristics of absorbing sound having a higher frequency than another of the soundproof structures 20 disposed on a side farther from the connection opening 24. That is, preferably, the sound reduction peak frequency of one of the soundproof structures 20 disposed on the side closer to the connection opening 24 is higher than the sound reduction peak frequency of another of the soundproof structures 20 disposed on the side farther from the connection opening 24.

To be specific, the soundproof structure disposed on the side closer to the connection opening 24 preferably has a peak of sound absorption coefficient at a frequency higher than the cut-off frequency of a flow path formed from the suction portion, the duct portion, the air blowing mechanism, and the flow regulation plate (that is, the flow path of the range hood excluding the soundproof structure). The soundproof structure disposed on the side farther from the connection opening preferably has a peak of sound absorption coefficient at a frequency lower than or equal to the cut-off frequency.

The term "cut-off frequency" refers to a frequency at or below which sound propagates as a planar wave in the flow path.

It is preferable that the soundproof structure 20 having frequency characteristics of absorbing sound having a higher frequency be disposed on the side closer to the connection opening 24, because, by doing so, the soundproof structure 20 on the side closer to the connection opening 24 can appropriately absorb high-frequency sound from the air blowing mechanism 16, and the other soundproof structure 20 disposed on the side farther from the connection opening 24 can appropriately absorb low-frequency sound that passes through the space between the suction portion 12 and the flow regulation plate 18.

For example, in the example illustrated in FIG. 16, the range hood has the following configuration: the range hood has air-column resonators 20Ba, 20Bb, and 20Bc having different frequency characteristics; the air-column resonator 20Bc having frequency characteristics of absorbing sound having the highest frequency is disposed on the side closest to the connection opening 24; the air-column resonator 20Ba having frequency characteristics of absorbing sound having the lowest frequency is disposed on the side farthest from the connection opening 24; and the air-column resonator 20Bb having frequency characteristics of absorbing sound having a frequency between these is disposed at a position farther from the connection opening 24 than the air-column resonator 20Bc and closer to the connection opening 24 than the air-column resonator 20Ba.

In the example illustrated in FIG. 17, among a plurality of through-holes formed in the perforated plate 36*b*, a through-hole that is formed on the central side in the in-plane direction is larger than a through-hole that is formed on the end portion side in the in-plane direction. Thus, the frequency of Helmholtz resonance that occurs due to the through-hole on the side closest to the connection opening 24, that is, the though-hole on the central side, has frequency characteristics of absorbing sound having a high frequency, and the frequency of Helmholtz resonance that occurs due to the through-hole on the side farthest from the connection opening 24, that is, the though-hole on the end portion side, has frequency characteristics of absorbing sound having a low frequency.

Here, as the soundproof structure 20, preferably, the membrane resonator 20D or the micro-perforated sheet 20E is used, in view of, for example, the following: any of these can be easily disposed in a small space between the suction portion and the flow regulation plate separated by a distance of 110 mm or smaller; high sound reducing effect can be obtained with a small-thickness configuration; and high soundproof performance can be obtained even when size is reduced.

In the example illustrated in FIG. 1, the air blowing mechanism 16 is disposed on the connection opening 24 (the suction portion 12) side of the duct portion 14. However, the position of the air blowing mechanism 16 is not limited to this, and may be disposed in the duct portion 14. In view of space and the like, preferably, the air blowing mechanism 16 is disposed on the connection opening 24 side of the duct portion 14.

Here, when the air blowing mechanism 16 is disposed on the discharge opening 26 side of the duct portion 14, the soundproof structure 20 may be disposed in the duct portion 14. However, when the air blowing mechanism 16 is disposed on the connection opening 24 side of the duct portion 14, it is difficult to block sound because there is no space in the duct portion 14 for disposing the soundproof structure 20.

In contrast, in the range hood according to the present invention, the soundproof structure 20 is disposed on the flow regulation plate 18 between the flow regulation plate 18 and the suction portion 12. Therefore, it is possible to dispose the soundproof structure 20 and to block sound even when the air blowing mechanism 16 is disposed on the connection opening 24 side of the duct portion 14.

Preferably, the soundproof structure 20 is attached to the flow regulation plate 18 via a removable mechanism. By configuring the soundproof structure 20 so as to be removable from the flow regulation plate 18, it is possible to make the soundproof structure 20 easily replaceable when oil stains and the like adhere thereto.

Examples of the removable mechanism include MAGICTAPE (registered trademark), a magnet, a button, a suction cup, a screw, and a fitting structure of fitting a protrusion and a recess to each other. A plurality of these mechanisms may be used in combination.

When the soundproof structure 20 is the air-column resonator 20B or the Helmholtz resonator 20C, preferably, a surface in which an opening is formed is a removable plate-shaped member (perforated plate).

When the soundproof structure 20 is the membrane resonator 20D, preferably, the membrane member 34 is removable.

Thus, when oil stains and the like adhere, it is easy to replace the stained portion.

Preferably, the surface of the soundproof structure 20 on the opposite side from the flow regulation plate 18 is substantially flat.

Here, the term "substantially flat" means the following: when the surface of the soundproof structure 20 on the side opposite from the flow regulation plate 18 (hereafter, also referred to simply as "the surface") is measured with resolving power of 1 mm, the surface does not have a protrusion of 50% or higher, more preferably 25% or higher, and further preferably 10% or higher of the distance between the suction portion 12 and the flow regulation plate 18. When the surface has a through-hole, preferably, the ratio the area of the through-hole to the area of the surface when the surface is seen in the perpendicular direction is lower than 50%.

By making the surface of the soundproof structure 20 on the side opposite from the flow regulation plate 18 substantially flat, it is possible to reduce decrease of airflow and to suppress generation of airflow noise. In particular, when a Helmholtz resonator or an air-column resonator is used as the soundproof structure, airflow noise tends to cause a problem because the resonance structure amplifies airflow noise. In this case, it is effective to suppress generation of airflow noise by making the surface of the soundproof structure 20 on the side opposite from the flow regulation plate 18 substantially flat.

The height of the soundproof structure 20 from the surface of the flow regulation plate 18 is preferably 1.5 times or smaller, more preferably 1.3 times or smaller, and further preferably 1.1 times or smaller of the length of the bent portion 30 of the flow regulation plate 18; and most preferably, the thickness of the porous sound absorber is smaller than or equal to the length of the bent portion 30 of the flow regulation plate 18. Thus, it is possible to suppress decrease of airflow amount and to reduce airflow noise that is generated by the bent portion 30.

When the soundproof structure 20 is only one of the porous sound absorber 20A, the air-column resonator 20B, the Helmholtz resonator 20C, and the membrane resonator 20D in the vertical direction (direction perpendicular to the surface of the flow regulation plate 18), the thickness of the soundproof structure 20 is substantially equal to the height of the soundproof structure 20 from the surface of the flow regulation plate 18, and therefore the thickness of the soundproof structure 20 is preferably in the range described above.

When a plurality of soundproof structures 20 are stacked in the vertical direction (direction perpendicular to the surface of the flow regulation plate 18), preferably, the height from the surface of the flow regulation plate 18 to the uppermost soundproof structure 20 is in the range described above.

The material of each of the members (the frame 32, the membrane member 34, the perforated plate 36*a*, and the like) of the soundproof structure 20 is not particularly limited, and any material that can be used for a range hood may be used.

To be specific, examples of the material include a metal material, a resin material, a reinforced plastic material, carbon fiber, and the like. Examples of the metal material include aluminum, titanium, magnesium, tungsten, iron, steel, chrome, chrome molybdenum, nichrome molybdenum, and alloys of these metals. Examples of the resin material include acrylic resin, polymethyl methacrylate, polycarbonate, polyamide-imide, polyalylate, polyetherimide, polyacetal, polyetheretherketone, polyphenylene sulfide, polysulphone, polyethylene terephthalate, polybutylene terephthalate, polyimide, ABS resin (acrylonitrile butadiene styrene copolymer), polypropylene, and triacetylcellulose. Examples of the reinforced plastic material include carbon fiber reinforced plastic (CFRP) and glass fiber reinforced plastic (GFRP).

Here, preferably, the soundproof structure 20 is made of a material having higher heat resistance than a fire-retardant material, or an incombustible material. Heat resistance can be defined by, for example, the time that satisfies the items of Article 108bis(2) of Order for Enforcement of the Building Standards Act. A case where the time that satisfies the items of Article 108bis(2) of Order for Enforcement of the Building Standards Act is 5 minutes or longer and shorter than 10 minutes is a fire-retardant material, a case where the time is 10 minutes or longer and shorter than 20 minutes is a sub-incombustible material, and a case where the time is 20 minutes or longer is an incombustible material. However, heat resistance is usually defined for each field. Therefore, in accordance with the field in which the range hood is to be used, it is preferable that the soundproof structure 20 be made of a material having heat resistance corresponding to or higher than the fire retardancy defined for the field.

Examples of the incombustible porous sound absorber 20A include felt made of glass fiber (SGM Super Glass Mat, Yamato Riken Kogyo Co., Ltd.), a member using ceramic fiber and glass fiber (CGM Ceramic Glass Mat, Yamato Riken Kogyo Co., Ltd.), rock wool (RGM Rock Wool Glass Mat, Yamato Riken Kogyo Co., Ltd.), and a sound-absorbing material made of metal fiber (POAL, Unix Co., Ltd.).

Examples of the material of the membrane member 34 include various metals such as aluminum, titanium, nickel, permalloy, 42 alloy, kovar, nichrome, chrome, beryllium, phosphor bronze, brass, nickel silver, tin, zinc, iron, tantalum, niobium, molybdenum, zirconium, gold, silver, platinum, palladium, steel, tungsten, lead, and iridium; and resin materials such as polyethylene terephthalate (PET), triacetylcellulose (TAC), polyvinylidene chloride, polyethylene, polyvinyl chloride, polymethylpentene, cycloolefin polymer (COP), polycarbonate, ZEONOR, polyethylene naphthalate (PEN), polypropylene, and polyimide. Further, a glass material, such as thin-film glass fiber, or reinforced plastic materials such as carbon fiber reinforced plastic (CFRP) and glass fiber reinforced plastic (GFRP) may be used. Alternatively, a combination of these materials may be used.

When a metal material is used, in view of prevention of rust and the like, the surface may be metal plated.

The Young's modulus of the membrane member 34 is not particularly limited, as long as the membrane member 34 can perform membrane vibration. The Young's modulus of the membrane member 34 is preferably 1000 Pa to 3000 GPa, more preferably 10000 Pa to 2000 GPa, and most preferably 1 MPa to 1000 GPa.

The density of the membrane member 34 is not particularly limited, as long as the membrane member 34 can perform membrane vibration. The density of the membrane member 34 is preferably 10 $kg/m^3$ to 30000 $kg/m^3$, more preferably 100 $kg/m^3$ to 20000 $kg/m^3$, and most preferably 500 $kg/m^3$ to 10000 $kg/m^3$.

The thickness of the membrane member 34 is not particularly limited, as long as the membrane member 34 can perform membrane vibration. For example, the thickness of the membrane member 34 is preferably 0.005 mm (5 μm) to 5 mm, more preferably 0.007 mm (7 μm) to 2 mm, and most preferably 0.01 mm (10 μm) to 1 mm.

As described above, the shape of the opening cross section of the frame 32 is not particularly limited, and may be, for example, a quadrangle such as a square, a rectangle, a rhombus, or a parallelogram; a triangle such as a regular triangle, an equilateral triangle, or a right triangle; a polygon such as a pentagon or a hexagon; a circle; an ellipse; or an irregular shape.

The plate-thickness and the thickness of the frame 32 are not particularly limited, as long as the frame 32 can securely fix and support the membrane member 34, and may be set, for example, in accordance with the size of the opening cross section of the frame 32 and the like.

A method of fixing the membrane member 34 to the frame 32 is not particularly limited, and a method using a double-sided tape or an adhesive, a mechanical fixing method such as screwing, press-bonding, or the like may be used as appropriate.

Heretofore, various embodiments of a range hood according to the present invention have been described in detail. However, the present invention is not limited to these embodiments and may be improved or modified within the spirit and scope of the present invention.

EXAMPLES

Hereafter, the present invention will be described in further detail based on Examples. Materials, the amounts of materials used, ratios, processes, procedures, and the like described below may be appropriately changed within the spirit and scope of the present invention. Accordingly, the scope of the present invention should not be interpreted as limiting from the Examples described below.

Example 1

As a range hood, FY-7HZCJ4 made by Panasonic Corporation was used.

The distance between the suction portion and the flow regulation plate of the range hood was 40 mm.

The size of the suction opening was 748 mm×600 mm.

The size of the flow regulation plate in the in-plane direction was 637 mm×468 mm, and the thickness of the flow regulation plate was 0.5 mm.

The size of the connection opening was 300 mm×270 mm.

The air blowing mechanism was disposed on the connection opening side of the duct portion.

A soundproof structure described below was disposed on the flow regulation plate of the range hood, and the noise generated when air was sucked at "High Speed" was recorded and measured by using an iPhone 5 (Apple Inc.) to which a microphone (iQ7, made by ZOOM Corporation) was connected.

As the soundproof structure, two micro-perforated sheets 20E were used by arranging these in a direction perpendicular to the flow regulation plate 18.

As each of the micro-perforated sheets 20E, an aluminum foil having a thickness of 20 μm and a size of 300 mm×400 mm and having micro through-holes having an average opening diameter of 25 μm with an average opening ratio of 6% was used.

As the frame 32 for supporting the micro-perforated sheets 20E, an acrylic plate having a thickness of 5 mm and having through-holes each having a size of 20 mm×20 mm was used.

An acrylic plate having a thickness of 0.5 mm was placed on the lower surface of a first frame 32, and a first micro-perforated sheet 20E was fixed to the upper surface of the first frame 32 by using a double-sided tape. Moreover, a second frame 32 was placed on the first micro-perforated sheet 20E, and a second micro-perforated sheet 20E was placed on the upper surface of the second frame 32 by using a double-sided tape (see FIG. 15).

These frames 32 and micro-perforated sheets 20E were placed on the flow regulation plate 18.

Comparative Example 1

Except that the micro-perforated sheets 20E and the frames 32 were not placed, noise was measured in the same way as in Example 1.

Figure 18:
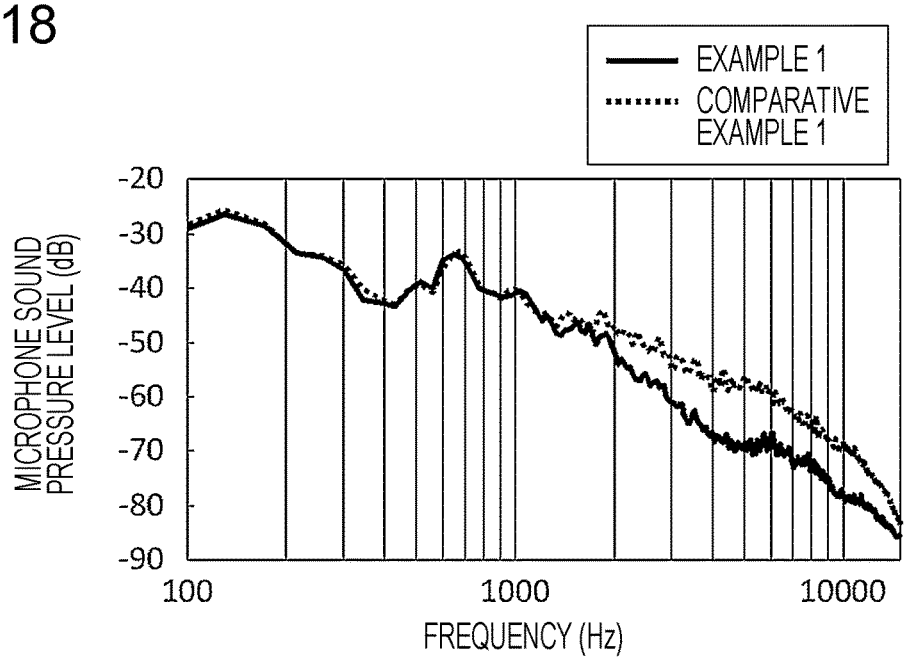
FIG. 18 is a graph representing the relationship between the frequency and the microphone sound pressure level.

FIG. 18 shows the results. FIG. 18 is a graph representing the relationship between the frequency and the microphone sound pressure level.

From FIG. 18, it can be seen that high soundproof effect can be obtained at frequencies of 2000 Hz or higher by disposing the soundproof structure on the flow regulation plate.

Example 2

A range hood was produced in the same way as in Example 1 except that a porous sound absorber 20A described below was used as the soundproof structure, and noise was measured by using the same method as described above.

The porous sound absorber 20A was urethane (product name: CALMFLEX, made by INOAC Corporation) having a size of 637 mm×468 mm and a thickness of 1 mm. The porous sound absorber 20A was placed on the flow regulation plate 18 as in the example illustrated in FIG. 1.

Figure 19:
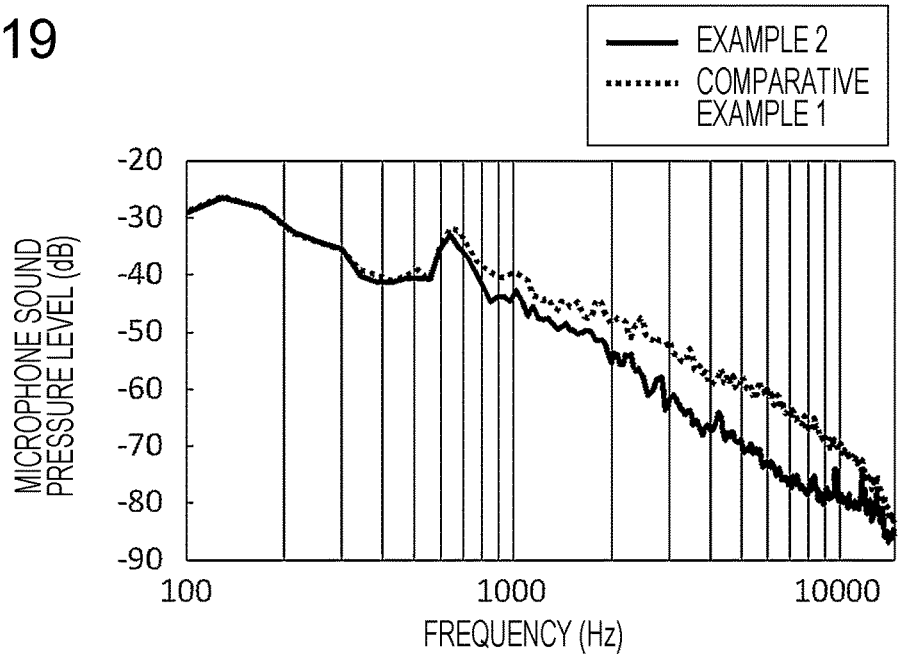
FIG. 19 is a graph representing the relationship between the frequency and the microphone sound pressure level.

FIG. 19 shows the results. FIG. 19 is a graph representing the relationship between the frequency and the microphone sound pressure level.

From FIG. 19, it can be seen that high soundproof effect can be obtained in the frequency range of 1000 Hz or higher and 10000 Hz or lower by disposing the soundproof structure on the flow regulation plate.

Example 3

A range hood was produced in the same way as in Example 1 except that a Helmholtz resonator 20C described below was used as the soundproof structure, and noise was measured by using the same method as described above.

The Helmholtz resonator 20C was a paper honeycomb structure in which a large number of honeycomb cores, each having a thickness of 15 mm in the vertical direction and a distance between facing surfaces of 10 mm, were arranged in a frame. A surface of the frame on the lower side in the vertical direction is covered by a kraft paper sheet having a thickness of 1 mm. As a perforated plate, an acrylic plate having a thickness of 1 mm and in which through-holes each having a diameter of 1 mm were arranged in a staggered manner at a 12 mm pitch was used. The perforated plate was disposed on a surface of the frame on the lower side in the vertical direction, thereby forming the Helmholtz resonator 20C.

Figure 20:
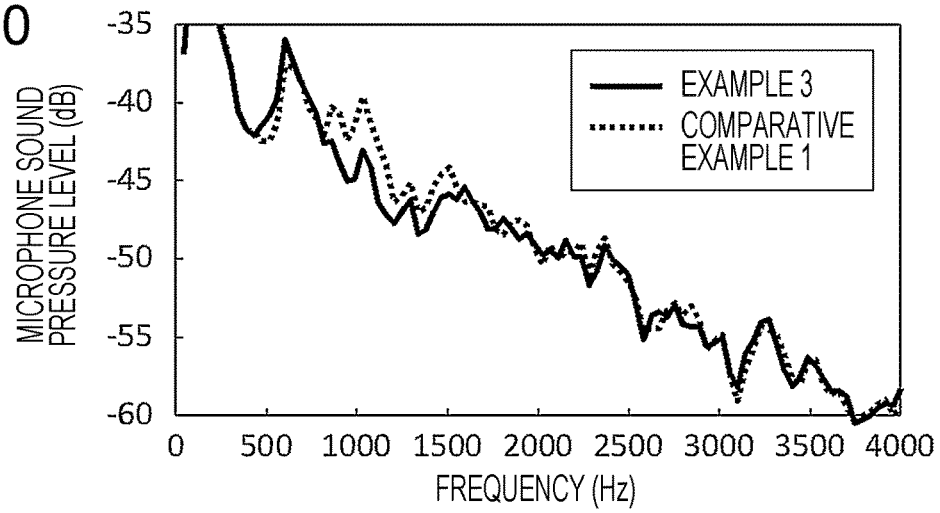
FIG. 20 is a graph representing the relationship between the frequency and the microphone sound pressure level.

FIG. 20 shows the results. FIG. 20 is a graph representing the relationship between the frequency and the microphone sound pressure level.

From FIG. 20, it can be seen that high soundproof effect can be obtained in the frequency range of 800 Hz to 1500 Hz by disposing the soundproof structure on the flow regulation plate.

Example 4

Figure 21:
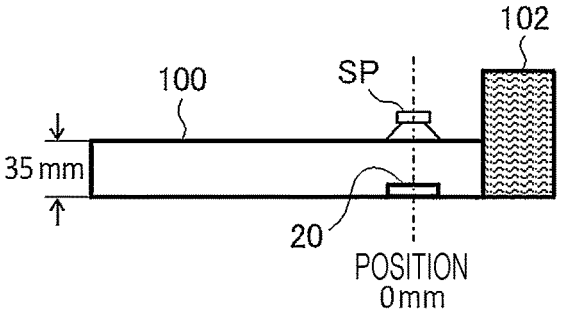
FIG. 21 is a side view illustrating a measurement system in an Example.
Figure 22:
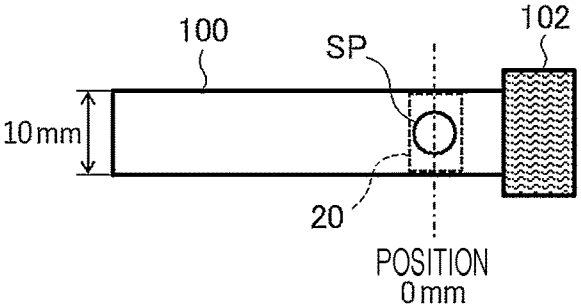
FIG. 22 is a top view illustrating the measurement system in the Example.

In order to measure the positional dependency of the soundproof structure 20, a measurement system simulating a range hood as illustrated in FIGS. 21 and 22 was produced. A speaker SP was disposed on an upper surface, in the vicinity of one of opening surfaces, of an acrylic duct 100 having an inside diameter of 35 mm×100 mm and a length of 280 mm. A sound-absorbing sponge 102 was disposed as a sound absorber at the opening surface on the speaker SP side.

Figure 23:
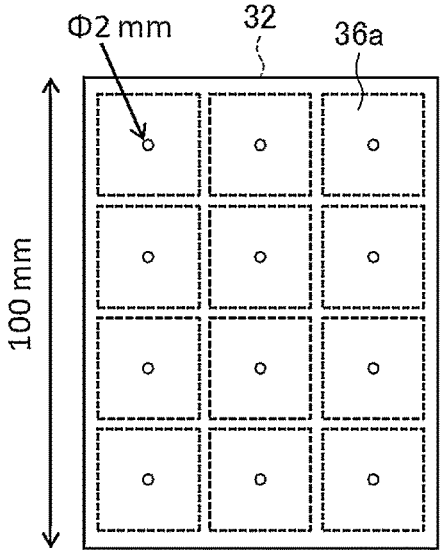
FIG. 23 is a top view of a soundproof structure 1 of the Example.
Figure 24:
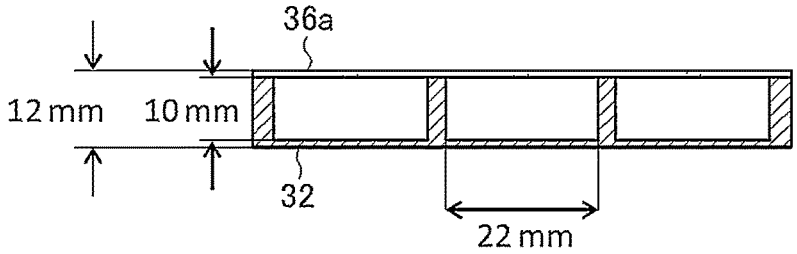
FIG. 24 is a sectional view of FIG. 23.
Figure 25:
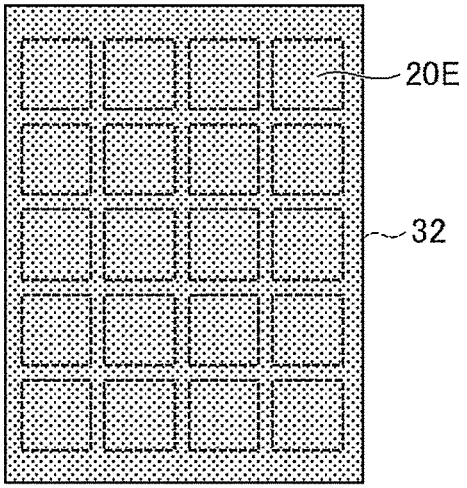
FIG. 25 is a top view of a soundproof structure 2 of the Example.
Figure 26:
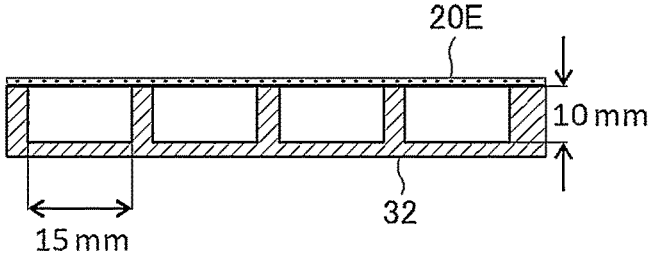
FIG. 26 is a sectional view of FIG. 25.

As soundproof structures 20, a Helmholtz resonator illustrated in FIGS. 23 and 24 (hereafter, referred to as a soundproof structure 1) and a micro-perforated sheet illustrated in FIGS. 25 and 26 (hereafter, referred to as a soundproof structure 2) were prepared.

As illustrated in FIGS. 23 and 24, the soundproof structure 1 had the frame 32 having 3×4 hollow portions and the perforated plate 36*a* having 3×4 openings. Each hollow portion had a size of 22 mm×22 mm and a depth of 10 mm, and each opening had a diameter of 2 mm.

As illustrated in FIGS. 25 and 26, the soundproof structure 2 had the frame 32 having 3×4 hollow portions and the micro-perforated sheet 20E having a size covering the frame 32. As in Example 1, the micro-perforated sheet 20E had an average opening diameter of 25 μm, an average opening ratio of 6%, and a thickness of 20 μm.

The two-types of soundproof structures were disposed in the duct 100, noise emitted from the opening surface of the duct 100 (an opening surface opposite from the opening surface at which the sound-absorbing sponge 102 was disposed) was measured by using a microphone, and the sound reduction amount relative to the noise level when a block having the same outer shape as the soundproof structure was disposed in the duct was calculated.

Measurement was performed at a plurality of positions, with the position of the speaker SP as a reference (0 mm), by changing the center position of the soundproof structure in the duct 100 in the longitudinal direction (hereafter, also referred to as device distance).

Figure 27:
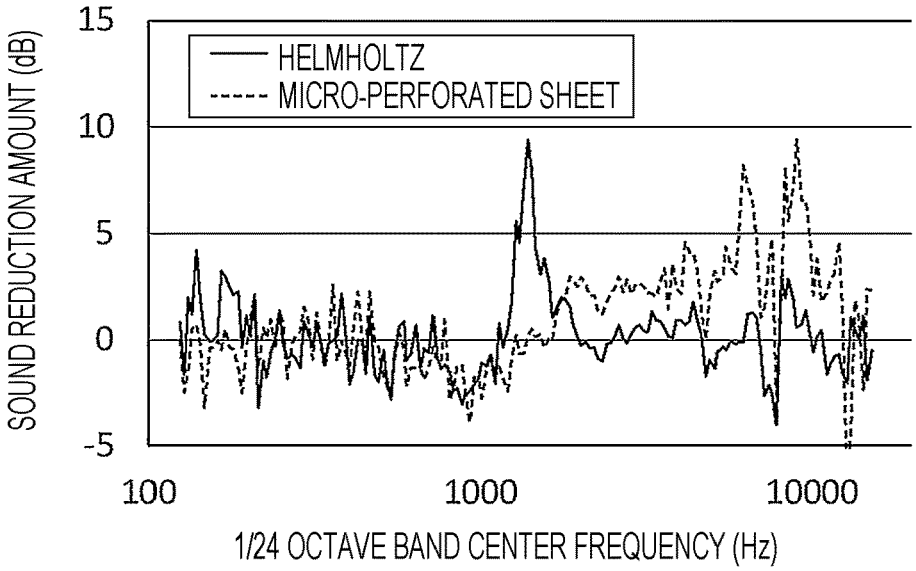
FIG. 27 is a graph representing the relationship between the frequency and the sound reduction amount.

FIG. 27 shows the sound reduction spectrum when the soundproof structure 1 and the soundproof structure 2 were respectively disposed at positions at a distance of 38 mm from the speaker Sp. It can be seen that the soundproof structure 1 has a sound reduction peak of Helmholtz resonance at 1390 Hz. It can be seen that the soundproof structure 2 reduces sound in a wide range of 3 to 13 kHz.

Figure 28:
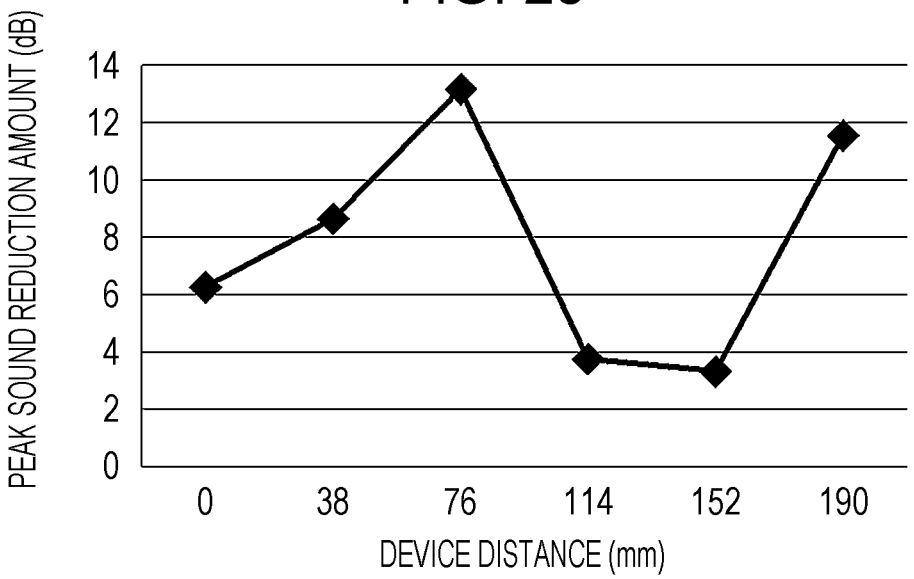
FIG. 28 is a graph representing the relationship between the device distance and the peak sound reduction amount.

FIG. 28 is a graph representing the relationship between the position (device distance) of the soundproof structure 1 and the sound reduction amount at the sound reduction peak. The sound reduction amount increases as the distance from the speaker SP increases, decreases as the distance further increases, and increases again as the distance further increases. The reason for this is as follows: because sound having a frequency around 1390 Hz has a frequency lower than the cut-off frequency of the structure of the duct 100, the sound causes interference in the duct 100 and a standing wave is generated, and sound reduction ability changes in accordance with the strength distribution thereof.

Figure 29:
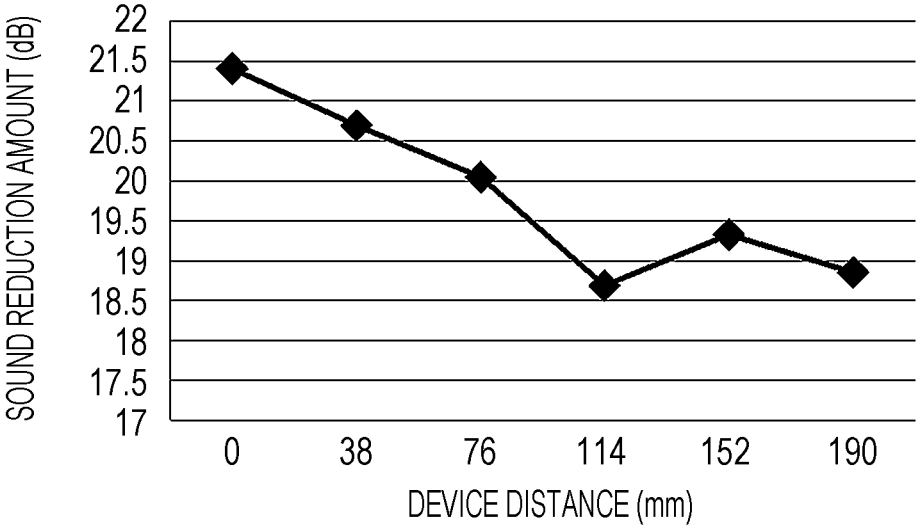
FIG. 29 is a graph representing the relationship between the device distance and the sound reduction amount.

FIG. 29 is a graph representing the relationship between the position (device distance) of the soundproof structure 2 and the sound reduction amount (accumulated for 3 to 10 kHz). In FIG. 29, it can be seen that, in contrast to FIG. 28, the sound reduction amount decreases as the distance from the speaker SP increases. It is considered that that such a result is obtained because the frequency of sound that the soundproof structure 2 reduces is higher than the cut-off frequency of the duct 100 and therefore strong interference does not occur in the duct 100.

From these result, it can be seen that, in order to effectively reduce sound by using soundproof structures having different sound reduction frequency characteristics, it is preferable that one of the soundproof structures having sound reduction characteristics at a frequency higher than the cut-off frequency be disposed on the sound-source side, and the other soundproof structure having sound reduction characteristics at a frequency lower than or equal to the cut-off frequency be disposed at a position away from the sound source.

The advantageous effects of the present invention are clear from the forgoing descriptions.

REFERENCE SIGNS LIST

3 sheet member
5 through-hole
10 range hood
12 suction portion
14 duct portion
16 air blowing mechanism
18 flow regulation plate
20 soundproof structure
20A porous sound absorber
20B, 20Ba to 20Bc air-column resonator
20C Helmholtz resonator
20D membrane resonator
20E micro-perforated sheet
22 suction opening
24 connection opening
26 discharge opening
30 bent portion
32 frame
34 membrane member
36*a*, 36*b* perforated plate

What is claimed is:

1. A range hood comprising:

a suction portion that has a suction opening and that sucks air from below in a vertical direction;

a duct portion that have a connection opening connected to the suction portion and conveys air sucked from the connection opening and discharges the air from a discharge opening to an outside;

an air blowing mechanism that is disposed in the duct portion and that moves air in the duct portion to the discharge opening; and a flow regulation plate that is disposed in the suction opening of the suction portion or is disposed so as to cover a part of the suction opening, wherein a distance between the suction portion and the flow regulation plate is 110 mm or smaller, and wherein the range hood has two or more soundproof structures having different frequency characteristics on a surface of the flow regulation plate on the suction portion side between the flow regulation plate and the suction portion; and a sound reduction peak frequency of one of the soundproof structures disposed on a side closer to the connection opening is higher than a sound reduction peak frequency of another of the soundproof structures disposed on a side farther from the connection opening, and wherein one of the soundproof structures disposed on a side closer to the connection opening has a peak of sound absorption coefficient at a frequency higher than a cut-off frequency in a flow path that is formed from the suction portion, the duct portion, the air blowing mechanism, and the flow regulation plate, and wherein another of the soundproof structures disposed on a side farther from the connection opening has a peak of sound absorption coefficient at a frequency lower than or equal to the cut-off frequency.

2. The range hood according to claim 1, wherein the distance between the suction portion and the flow regulation plate is 1 mm or larger and 110 mm or smaller.

3. The range hood according to claim 1, wherein a thickness of the soundproof structure is 100 mm or smaller.

4. The range hood according to claim 1, wherein an opening area of the suction opening of the suction portion is larger than an opening area of the connection opening, and wherein an area of the surface of the flow regulation plate on which the soundproof structure is disposed is smaller than the opening area of the suction opening and larger than the opening area of the connection opening.

5. The range hood according to claim 1, wherein the air blowing mechanism is disposed on the connection opening side in the duct portion.

6. The range hood according to claim 1, wherein at least one of the soundproof structure has a frame having at least one open surface and a membrane member disposed at the open surface of the frame, and wherein the membrane member is a membrane resonator that performs membrane vibration.

7. The range hood according to claim 1, wherein the soundproof structure has at least one acoustic resistance sheet whose acoustic flow resistivity is 10 to 5000 $Pa \cdot s/m^2$.

8. The range hood according to claim 1, wherein at least one of the soundproof structure is a micro-perforated sheet having a plurality of through-holes whose average opening diameter is 0.1 μm to 250 μm.

9. The range hood according to claim 1, wherein at least one of the soundproof structure is a Helmholtz resonator.

10. The range hood according to claim 1, wherein at least one of the soundproof structure is an air-column resonator.

11. The range hood according to claim 1, wherein at least one of the soundproof structure is a porous sound absorber.

12. The range hood according to claim 1, wherein the soundproof structure is made of a fire-retardant material or an incombustible material.

13. The range hood according to claim 1, wherein the soundproof structure is attached to the flow regulation plate via a removable mechanism.

14. A range hood comprising:

a suction portion that has a suction opening and that sucks air from below in a vertical direction;

a duct portion that have a connection opening connected to the suction portion and conveys air sucked from the connection opening and discharges the air from a discharge opening to an outside;

an air blowing mechanism that is disposed in the duct portion and that moves air in the duct portion to the discharge opening; and a flow regulation plate that is disposed in the suction opening of the suction portion or is disposed so as to cover a part of the suction opening, wherein a distance between the suction portion and the flow regulation plate is 110 mm or smaller, and wherein the range hood has two or more soundproof structures having different frequency characteristics on a surface of the flow regulation plate on the suction portion side between the flow regulation plate and the suction portion; and in an in-plane direction of the flow regulation plate, a sound reduction peak frequency of one of the soundproof structures disposed on a side closer to the connection opening is higher than a sound reduction peak frequency of another of the soundproof structures disposed on a side farther from the connection opening.

* * * * *